US007331504B2

(12) United States Patent
Languillat et al.

(10) Patent No.: US 7,331,504 B2
(45) Date of Patent: Feb. 19, 2008

(54) PARTIALLY ADHERED TUBE AND METHODS AND APPARATUS FOR MANUFACTURING SAME

(75) Inventors: Jean Paul Languillat, Vallieres (FR); Johannes Wilhelmus van de Camp, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 615 days.

(21) Appl. No.: 10/850,138

(22) Filed: May 20, 2004

(65) Prior Publication Data

US 2005/0258219 A1 Nov. 24, 2005

(51) Int. Cl.
*B65D 3/28* (2006.01)

(52) U.S. Cl. ..... 229/4.5; 493/112; 493/114; 493/128

(58) Field of Classification Search ..... 229/4.5, 229/198.2, 93; 493/112, 114, 128
See application file for complete search history.

(56) References Cited

U.S. PATENT DOCUMENTS

| | | | | |
|---|---|---|---|---|
| 428,188 | A | 5/1890 | Videto | |
| 1,936,136 | A * | 11/1933 | Lindgren | 493/128 |
| 2,432,053 | A | 12/1947 | Waters | |
| 2,543,229 | A | 2/1951 | Chapman | |
| 2,544,146 | A | 3/1951 | Erikson | |
| 2,674,974 | A | 4/1954 | Gwinn et al. | |
| 2,720,665 | A | 10/1955 | Kile | |
| 2,765,766 | A | 10/1956 | Davis et al. | |
| 2,875,724 | A | 3/1959 | Joa | |
| 2,891,714 | A | 6/1959 | Vallas | |
| 3,015,596 | A | 1/1962 | Couch et al. | |
| 3,144,193 | A | 8/1964 | Geist et al. | |
| 3,162,347 | A | 12/1964 | Taylor | |
| 3,174,676 | A | 3/1965 | Stump et al. | |
| 3,221,975 | A | 12/1965 | Zoeller et al. | |
| 3,270,778 | A | 9/1966 | Foll et al. | |
| 3,331,549 | A | 7/1967 | Beasley | |

(Continued)

FOREIGN PATENT DOCUMENTS

| | | |
|---|---|---|
| DE | 43 41 443 C1 | 3/1995 |

(Continued)

OTHER PUBLICATIONS

International Search Report for PCT Application No. PCT/GB2005/017574, Filed May 19, 2005.

*Primary Examiner*—Gary E Elkins
(74) *Attorney, Agent, or Firm*—Alston & Bird LLP

(57) ABSTRACT

A tube includes a structural ply wrapped around an axis of the tube, and adhesive which adheres an outer surface of the structural ply to an inner surface. The inner surface is part of the structural ply, or it is part of a second ply of the tube. The outer surface confronts the inner surface, and the adhesive is arranged in a predetermined pattern so that only a predetermined percentage of the outer surface is substantially adhered to the inner surface (e.g., the tube is only "partially adhered"). The predetermined pattern can include three or more stripes of the adhesive, and the predetermined percentage can be substantially less than 100%. The predetermined pattern is preferably provided by apparatus for applying and/or arranging the adhesive on the ply in a predetermined pattern prior to the ply being formed into the tube.

30 Claims, 5 Drawing Sheets

U.S. PATENT DOCUMENTS

| | | | |
|---|---|---|---|
| 3,338,270 | A | 8/1967 | Denenberg |
| 3,355,348 | A | 11/1967 | Lamar |
| 3,366,493 | A | 1/1968 | Stump |
| 3,372,673 | A | 3/1968 | Di Mattia |
| 3,545,494 | A | 12/1970 | Cunningham |
| 3,587,526 | A | 6/1971 | Geschwender |
| 3,663,344 | A | 5/1972 | Brock et al. |
| 3,940,496 | A | 2/1976 | Turpin et al. |
| 3,972,468 | A | 8/1976 | Reid |
| 3,981,433 | A | 9/1976 | Thornhill et al. |
| 3,982,686 | A | 9/1976 | Parlour et al. |
| 3,988,521 | A | 10/1976 | Fumel et al. |
| 4,025,671 | A | 5/1977 | Creamer |
| 4,073,950 | A | 2/1978 | Hansen et al. |
| 4,093,073 | A | 6/1978 | Leezer |
| 4,295,840 | A | 10/1981 | Sansbury |
| 4,425,106 | A | 1/1984 | Boegli et al. |
| 4,757,940 | A | 7/1988 | Quick et al. |
| 4,777,053 | A | 10/1988 | Tobelmann et al. |
| 5,045,358 | A | 9/1991 | Watanabe et al. |
| 5,076,440 | A | 12/1991 | Drummond |
| 5,136,972 | A | 8/1992 | Naka et al. |
| 5,145,528 | A | 9/1992 | Watanabe et al. |
| 5,230,737 | A | 7/1993 | Takada et al. |
| 5,251,809 | A | 10/1993 | Drummond et al. |
| 5,487,506 | A | 1/1996 | Drummond et al. |
| 5,494,215 | A | 2/1996 | Drummond et al. |
| 5,536,312 | A | 7/1996 | Madrzak et al. |
| 5,597,618 | A | 1/1997 | Bayer, Jr. et al. |
| 5,795,387 | A | 8/1998 | Huerta |
| 6,007,627 | A | 12/1999 | Barnholtz |
| 6,230,968 | B1 | 5/2001 | Varadarajan |
| 6,409,078 | B2 | 6/2002 | Varadarajan |
| 6,537,376 | B1 | 3/2003 | Yasui et al. |
| 6,815,022 | B2 * | 11/2004 | Renck et al. ..... 428/34.3 |
| 2001/0019076 | A1 | 9/2001 | Varadarajan |
| 2002/0036228 | A1 * | 3/2002 | Reese et al. ..... 229/4.5 |

FOREIGN PATENT DOCUMENTS

| | | |
|---|---|---|
| EP | 0 857 567 A2 | 8/1998 |
| EP | 0 857 568 A2 | 8/1998 |
| GB | 1 544 938 | 4/1979 |

* cited by examiner

PARTIALLY ADHERED TUBE AND METHODS AND APPARATUS FOR MANUFACTURING SAME

BACKGROUND OF THE INVENTION

The present invention pertains to tubes and, more particularly, to partially adhered tubes, and methods and apparatus for manufacturing them.

Tubes are often used as packages for containing products. For example, it is common to close the ends of tubes with caps to form containers for carrying products, such as food. Tubes are also commonly used as cores for having products, such as paper and textile goods, wound thereon. When tubes are used as cores, it is important that respective surfaces of the one or more plies of the tube be securely adhered to one another to ensure that the tubes can withstand the stresses that are incurred while products are wound onto, or unwound from, the tubes, and while the products are carried by the tubes. Accordingly, it is common for tubes used as cores to be "fully adhered", as described below.

A composite tube, which can be used as a core, can be made by wrapping plies of paperboard around an axis of the tube, so that an outer surface of an inner ply confronts, and is adhered to, an inner surface of an outer ply. It is typical in many situations for at least about 95% to 100% of the outer surface of the inner ply to be adhered to the inner surface of the outer ply. Tubes with that level of adhesion are often referred to as "fully adhered"

FIGS. 1-6 respectively illustrate composite tubes and methods and apparatus for manufacturing them, in accordance with some of the known prior art. FIG. 1 illustrates a portion of an apparatus 20 for making composite tubes 22 that include four plies 26*a*-*c*. The apparatus 30 includes a mandrel 24 about which the plies 26*a*-*c* are spirally wrapped to form a tubular structure 28. The tubular structure 28 is cut into lengths to form the tubes 22. The mandrel 24 has a cross-sectional shape corresponding to the desired cross-sectional shape of the tubes 22.

More specifically, an innermost ply 26*a* is spirally wound onto the mandrel 24 into a tubular shape to partially form the tubular structure 28. Adhesive is applied to what will become the inner surface of an inner body ply 26*b*, and then the inner surface of the inner body ply is wound onto and adhered to the outer surface of the innermost ply 26*a* to further partially form the tubular structure 28. Adhesive is applied to what will become the inner surface of an outer body ply 26*c*, and then the inner surface of the outer body ply is wound onto and adhered to the outer surface of the inner body ply 26*b* to further partially form the tubular structure 28. Adhesive is applied to what will become the inner surface of an outermost ply 26*d*, and then the inner surface of the outermost ply is wound onto and adhered to the outer surface of the outer body ply 26*c* to further form the tubular structure 28.

The outer surface of the tubular structure 28 is engaged by a winding belt 30 that is wrapped about a pair of winding cylinders 32 such that the belt 30 spirally advances the tubular structure along the mandrel 24. Although only a single winding belt 30 is shown in FIG. 1, additional winding belts may be employed at different locations along the tubular structure 28. At a position downstream from the winding belt 30, the tubular structure 28 is cut to desired lengths at a cutting station, to form the shorter tubes 22.

As illustrated in FIG. 2, caps 36 can be applied to the ends of a tube 22 to form a can. One of the caps 36 is partially cut away in FIG. 2 to show the interior of the can, which is where products may be contained. In contrast to what is illustrated in FIG. 2, it is common for a can with end caps 36 to include only one of the body plies 26*b* or 26*d*. The ends of the tubes 22 typically are not closed with caps 36 if the tubes 22 are to function as cores around which products are wound.

The body plies 26*b*, 26*c* can be referred to as structural body plies because each is typically thicker and stronger than the innermost ply 26*a* and the outermost ply 26*d*, such that the body plies 26*b*, 26*d* are responsible for providing a majority of the tube's strength. In contrast to the structural body plies 26*b*, 26*d*, which are selected primarily for their strength, the innermost ply 26*a* and the outermost ply 26*d* may be selected primarily for other reasons. For example, it is common for a tube that is used as a core to be temporarily mounted onto a spindle which carries the tube and causes the tube to rotate, and the innermost ply 26*a* can be selected so that it will be compatible with the rotating spindle. Similarly, the outermost ply 26*c* can be selected so that it will be compatible with the product that is wound onto the tube.

FIG. 3 schematically illustrates a known process for applying an adhesive 38 to a ply 26 before the ply is spirally wound upon, and adhered to, the ply which was most recently previously wrapped around the mandrel 24. The ply 26 illustrated in FIG. 3 can be any one of the plies 26*b*-*d* illustrated in FIG. 1. As schematically illustrated in FIG. 3, the ply 26 is drawn past any type of conventional applicator 27 that applies the adhesive 38 onto the top surface of the ply 26. Then, the ply 26 is drawn past a stationary scraper 40, and the scraper arranges the adhesive and causes excess adhesive to flow off of the ply.

FIG. 4 is a schematic plan view of the scraper 40, and FIG. 6 is an enlarged view of a small portion of the scraper. The scraper 40 is in the form of a cylindrical rod with a series of closely spaced apart recesses 42 formed therein. Only a representative few of the recesses are identified by their reference numeral in FIG. 4. The recesses 42 are identical and are uniformly spaced apart from one another along the length of the rod 40. Each of the recesses 42 encircles the rod 40, and each of the recesses is uniform along its annular length.

FIG. 5 is a schematic top plan view of a portion of the ply 26 of FIG. 3 at a position immediately downstream from the scraper 40. FIG. 5 illustrates that the adhesive 38 (see FIG. 3) has been arranged in a series of longitudinally extending, uniformly and closely spaced parallel stripes 44. Only a few of the adhesive stripes 44 are identified by their reference numeral in FIG. 5. The arrangement of the adhesive stripes 44 on the ply 26 corresponds to the arrangement of the recesses 42 on the scraper 40, because the recesses 42 arrange the adhesive stripes 44. At most, preferably only a relatively thin layer of the adhesive is between adjacent adhesive stripes 44 on the ply 26 of FIG. 5, because the scraper 40 scrapes the adhesive away from these areas.

The recesses 42 and, thus, the adhesive stripes 44 are sized and uniformly closely arranged so that when the inner surface of the ply 26 is spirally wound upon, and adhered to, the ply which was most recently previously wrapped around the mandrel 24, the adhesive stripes 44 spread and merge with one another so that at least about 95% to 100% of the inner surface of the ply 26 is substantially adhered to the outer surface of the ply which was most recently previously wrapped around the mandrel. Thereafter, the ply 26 can be characterized as being "fully adhered" since at least about 95% to 100% of the inner surface of the ply 26 is substantially adhered to the outer surface of the ply which was most recently previously wrapped around the mandrel.

U.S. Pat. Nos. 6,230,968 and 6,409,078 disclose a composite can with a body wall that is spirally wound so that its edges form a butt joint. The can may be opened at the butt joint to access the product contained therein. An exterior label is spirally wrapped about and adhered to the outer surface of the body wall. In addition, a spirally wrapped liner is adhered to an inner surface of the body wall.

As one example, the '968 patent indicates that the adhesive that is between the label, which is also referred to as a cover layer, and the body wall is applied in a predetermined substantially continuous pattern between the inner surface of the cover layer and the outer surface of the body wall, with the pattern having a relatively higher-density screen pattern applied to a first region of the cover layer that overlies the butt joint of the body wall and a relatively lower-density screen pattern applied to a second region of the cover layer remote from the butt joint.

As another example, the '078 patent indicates that the adhesive is applied in a predetermined pattern between the inner surface of the cover layer and the outer surface of the body wall, with the pattern providing substantially less than 100% adhesive coverage of said surfaces. It is further indicated, among other things and according to this example, that the adhesive on the liner is applied in a predetermined pattern such that the adhesive covers substantially less than 100% of the liner.

The '968 and '078 patents indicate that it is conventional to apply adhesives to substantially the entire surface of strips that are spirally wound together to form composite cans. These patents further indicate, for example, that their inventions enable increased green strength and dimensional stability of composite cans so that parent tubes can undergo secondary operations with less susceptibility to being damaged, and so that the holding period for green cans may be reduced or eliminated. These patents also indicate, for example, that the invention, in preferred embodiments, enables enhanced performance of composite cans, such as improved burst strength of dough cans while still permitting intact label removal.

The '968 and '078 patents provide important improvements in the field of cans that are made of multi-ply tubes. However, further improvements that provide other balances of properties are desired, particularly for tubes that are used as cores for having products wound thereon. Tubes that are used as cores are subjected to different types of stresses than tubes that are used as cans, particularly cans that are to be opened at a ply's butt joint; therefore, a different balance of properties is desired for tubes that can be used as cores.

BRIEF SUMMARY OF SOME ASPECTS OF THE INVENTION

In accordance with one aspect of the present invention, a tube includes at least a first ply wrapped around an axis of the tube, and adhesive which adheres an outer surface of the first ply to an inner surface. The inner surface can be part of the first ply, or it can be part of a second ply of the tube. The outer surface confronts the inner surface, and the adhesive is arranged in a predetermined pattern so that only a predetermined percentage of the outer surface is substantially adhered to the inner surface (e.g., the tube is only "partially adhered"). The predetermined pattern can include three or more stripes of the adhesive. The predetermined percentage will vary depending upon the demands to which the tubes will be exposed and the type of adhesive that is used. In one example, the predetermined percentage is preferably substantially less than 100% and large enough so that the outer surface is substantially securely attached to the inner surface. More specifically, the predetermined percentage can preferably be within a range of at least about 50% to about 90%, more preferably the range is about 70% to about 80%, and most preferably the predetermined percentage is about 75%.

In accordance with one aspect of the present invention, the first and second plies of the tube are structural plies that are each relatively strong as compared to optional, non-structural innermost and outermost plies of the tube. In addition, even though the predetermined pattern of the adhesive between the structural plies results in only partial adhesion between the structural plies, the predetermined pattern sufficiently secures the structural plies to one another so that the tube can be used as a core and withstand the significant stresses to which a core is exposed. In accordance with this aspect in which the structural plies are selected primarily for their strength, the optional innermost ply can be selected so that it will be compatible with a rotating spindle which will carry the tube, and the optional outermost ply can be selected so that it will be compatible with the product that will be wound onto the tube. All of the plies of the tube can be adhered with the same predetermined pattern, or different predetermined patterns may be used between different ones of the plies.

The predetermined patterns of the present invention advantageously allow for a reduction in the amount of adhesive used and thereby advantageously decrease the amount of moisture that is introduced into a tube during manufacturing. Reducing the moisture has numerous advantages, such as reducing or eliminating the requirement that tubes be dried during manufacturing. In addition, it has unexpectedly been found that the predetermined patterns do not result in significant sacrifices in the strength of the tubes. As an example, maintaining the strength of the tubes can be particularly beneficial when the tubes are used as cores, since cores can be exposed to significant stresses while products are wound onto them and unwound from them, and while the products are carried by them.

For each ply, the associated stripes of the adhesive can extend approximately parallel to the length of the ply, and the stripes of the adhesive and a plurality of second stripes can be arranged in an alternating, laterally extending series. Each of the stripes of the adhesive is preferably contiguous with at least one of the second stripes, and the second stripes are preferably at least substantially absent of adhesive. In one example, each of the second stripes and each of the stripes of the adhesive extend helically at least partially around the axis of the tube. For each ply, there can be three, four, five or more stripes of the adhesive, and likewise there can be three, four, five or more of the second stripes. Preferably each of the stripes extends substantially continuously from one end of the tube to the other end of the tube. The stripes of the adhesive can each have a width of about 10 millimeters, or the width can be in a range, for example, of about 9 millimeters to about 11 millimeters, or about 7.5 millimeters to about 12.5 millimeters.

In accordance with one aspect of the present invention, apparatus are provided for applying adhesive to a ply prior to the ply being formed into a partially adhered tube. In accordance with this aspect, the apparatus can advantageously provide for efficient application of the adhesive while the ply travels at high speed.

In accordance with one aspect of the present invention, a scraper is provided for confronting and arranging adhesive which was previously deposited on a surface of a ply which extends in, and is traveling in, a longitudinal direction. The scraper preferably includes unrecessed and recessed sections arranged in an alternating series that is for extending laterally across the ply and confronting the surface of the ply. Each of the unrecessed sections is contiguous with at least one of the recessed sections, and each of the recessed sections preferably includes a plurality of recesses. The recesses respectively arrange the adhesive in lines on the ply, whereas other portions of the scraper scrape the adhesive off the portions of the ply that are not covered with the lines of adhesive.

In accordance with the foregoing aspect, the recesses which are adjacent one another and within the same recessed section can be spaced apart from one another by at least about a first distance. In contrast, the recessed sections which are adjacent one another can be spaced apart from one another by at least about a second distance that is substantially larger than the first distance. The second distance is preferably at least about twice as large as the first distance. The unrecessed and recessed sections are preferably arranged in a manner that facilitates the manufacturing of a partially adhered core.

One aspect of the present invention is the provision of an applicator which can combine the functions of applying adhesive to a ply and arranging the adhesive on the ply. In accordance with one example of this aspect, the applicator includes a housing having at least one passageway for receiving the adhesive under pressure, and the applicator further includes an insert which removably fits in a cavity of the housing. The insert includes a face for confronting the ply while the ply is advanced along a path. The face includes at least one outlet opening that is in communication with the passageway for receiving the adhesive under pressure while the insert is in the cavity, so that the outlet opening is for discharging the adhesive onto the ply. The applicator is operative so that downstream from it, the adhesive on the surface of the ply is arranged in a predetermined pattern which is preferably for facilitating the manufacturing of a partially adhered core. It can be advantageous for the insert to be interchangeable with other inserts for providing different adhesive patterns which may also be for facilitating the manufacturing of partially adhered cores.

The applicator can include different features for providing the desired adhesive pattern. For example, the applicator can include unrecessed and recessed sections that are generally as described above for the scraper. Also, the outlet opening can be one of a plurality of outlet openings that are arranged in an alternating series. In accordance with alternative embodiments of the present invention, the housing and the insert are combined into an inseparable unit, or the insert can be used without the housing.

Similar to the scraper, the features of the applicator preferably are arranged to function in a manner which facilitates the manufacturing of partially adhered cores. However, the scraper and applicator can be used for other purposes.

Other aspects and advantages of the present invention will become apparent in view of the following.

BRIEF DESCRIPTION OF THE DRAWINGS

Figure 1:
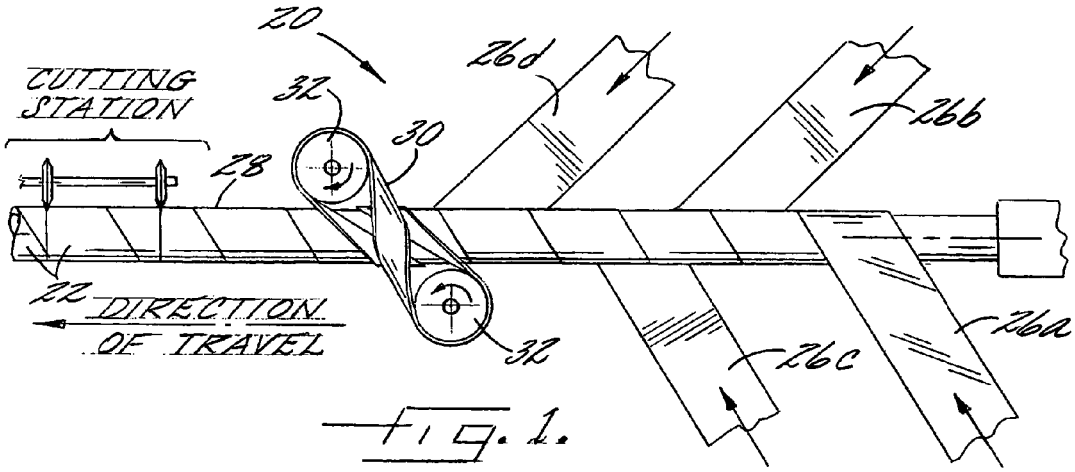
Fig. 1. (PRIOR ART)
Figure 2:
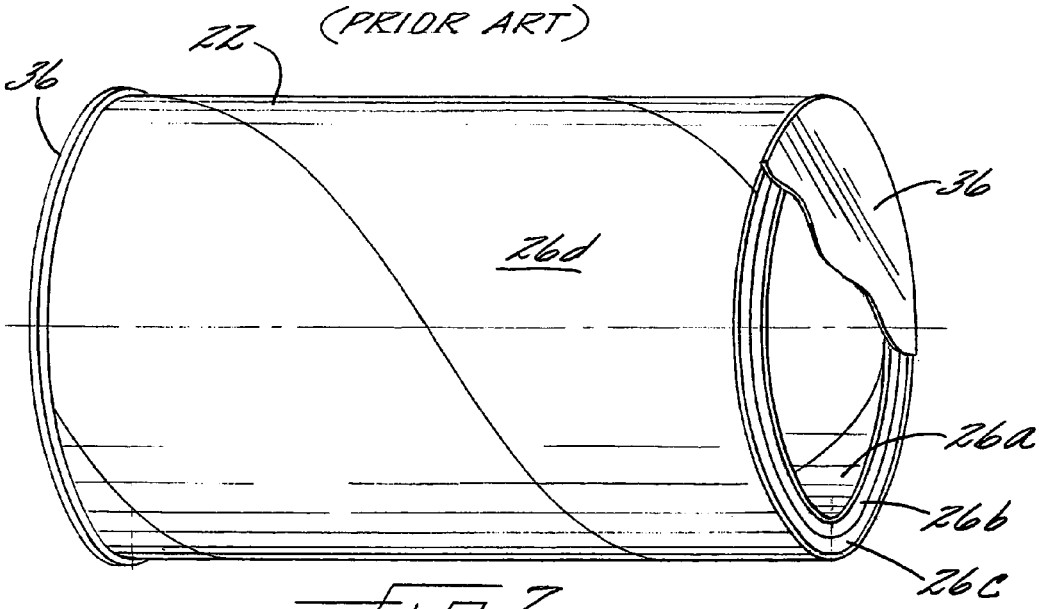
Fig. 2. (PRIOR ART)
Figure 3:
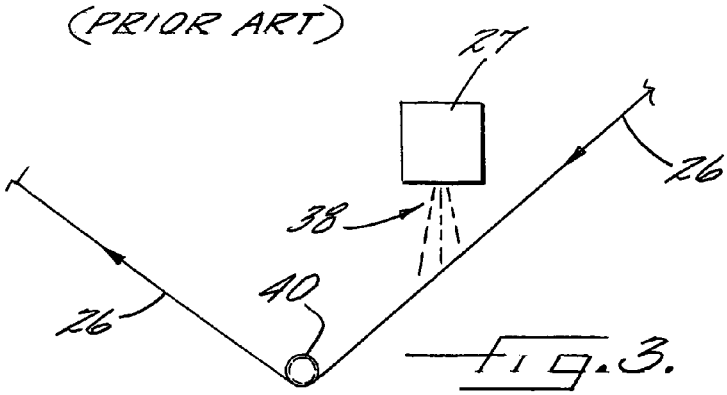
Fig. 3. (PRIOR ART)
Figure 4:
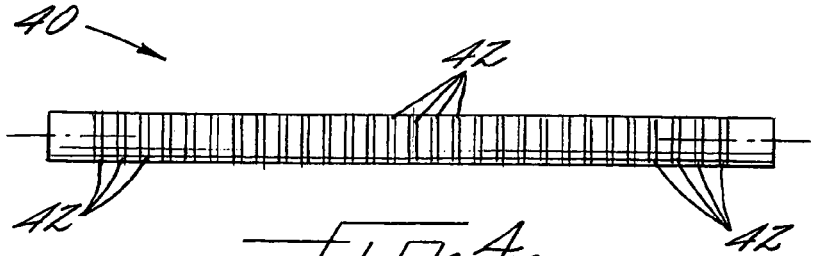
FIG. 4. (PRIOR ART)
Figure 5:
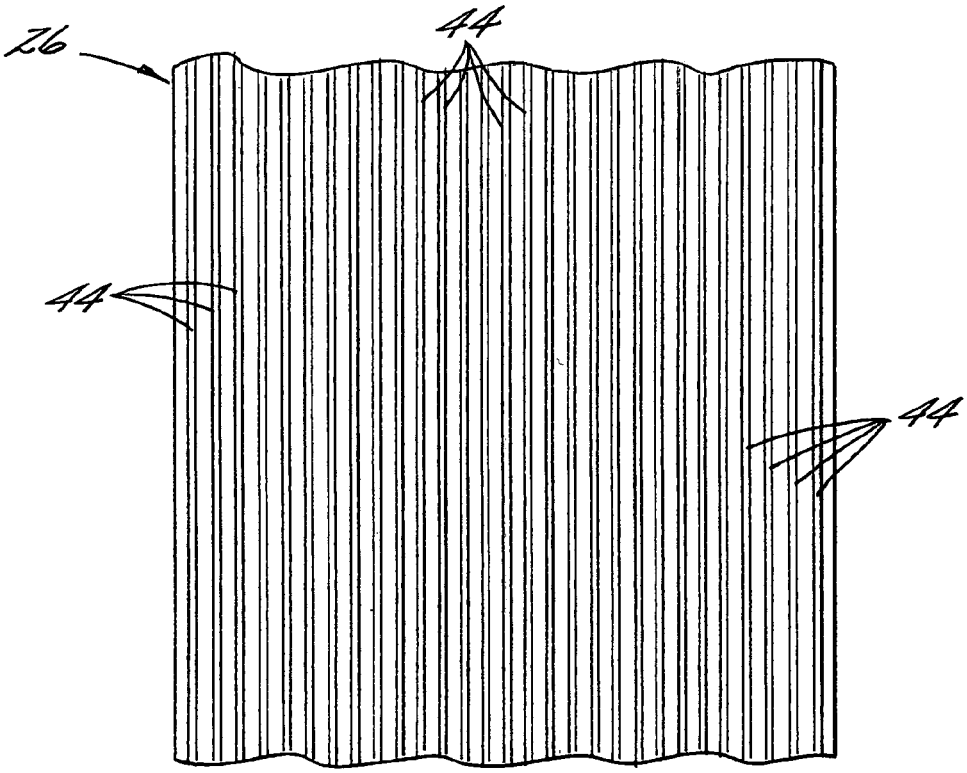
FIG. 5. (PRIOR ART)
Figure 6:
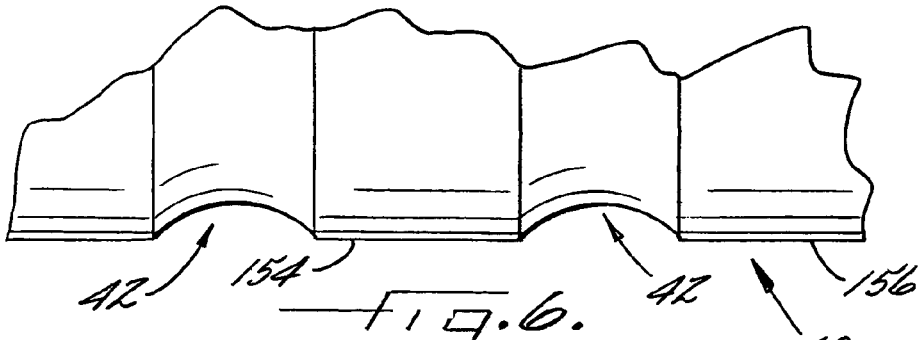
FIG. 6. (PRIOR ART)
Figure 7:
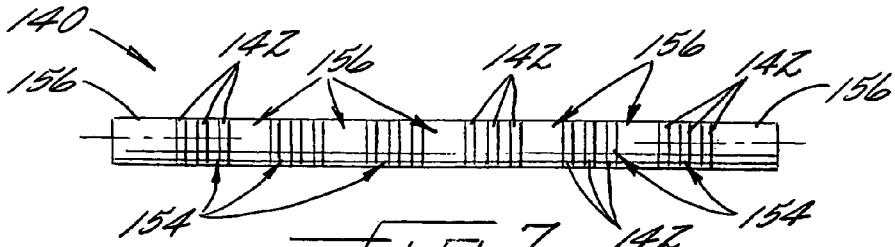
Figure 8:
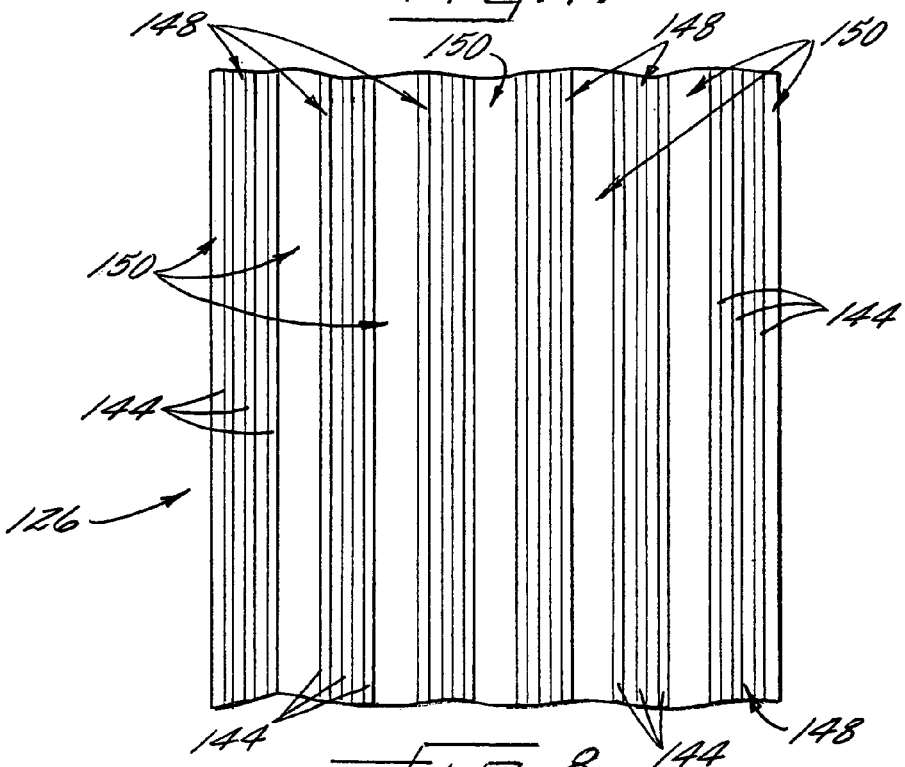
Figure 9:
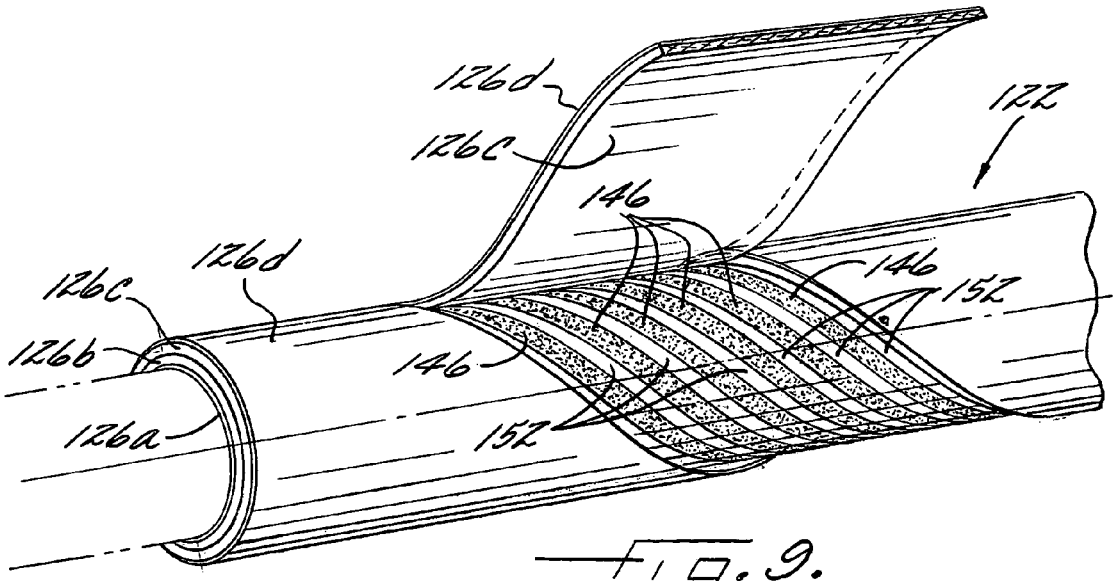
Figure 10:
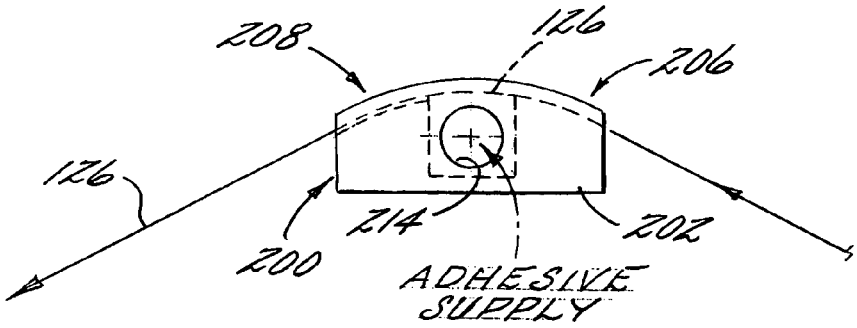
Figure 11:
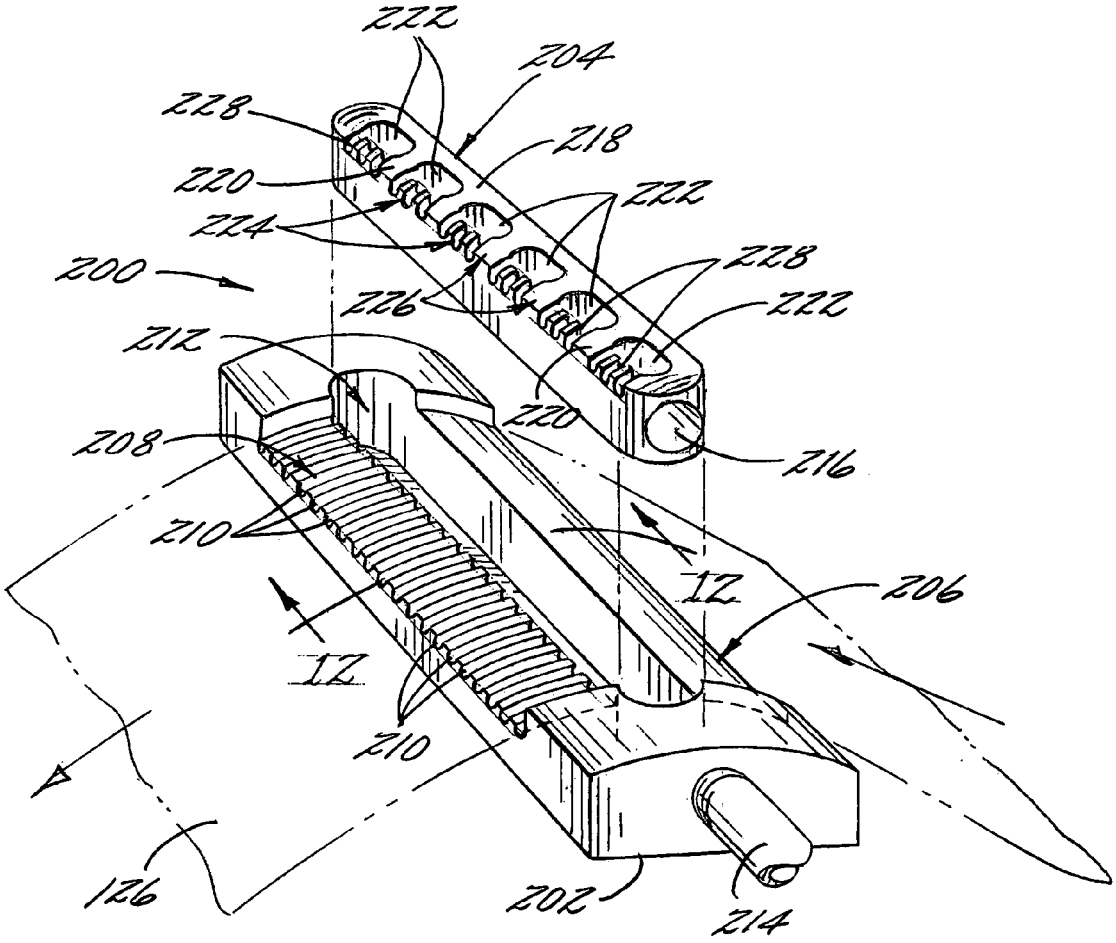
Figure 12:
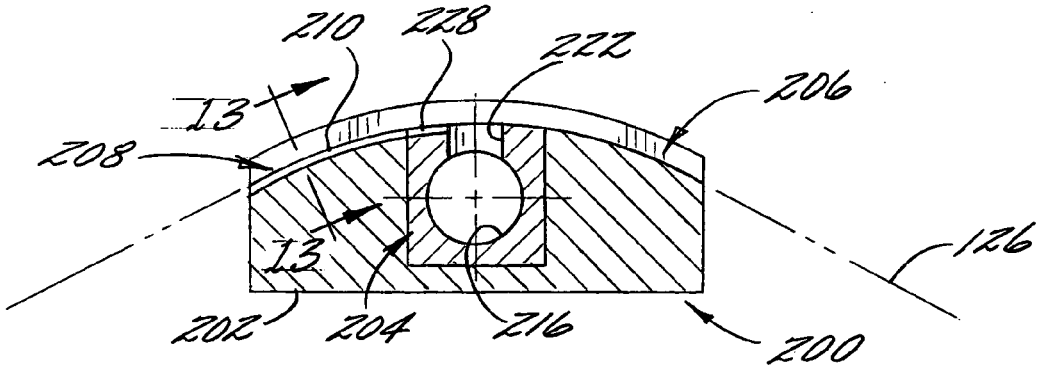
Figure 13:
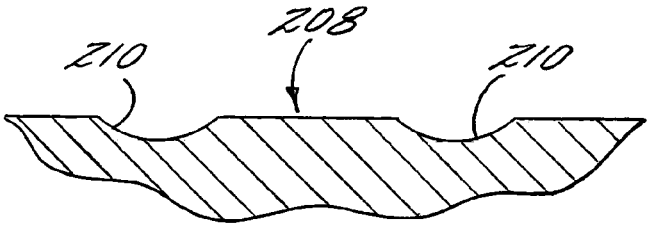
Figure 14:
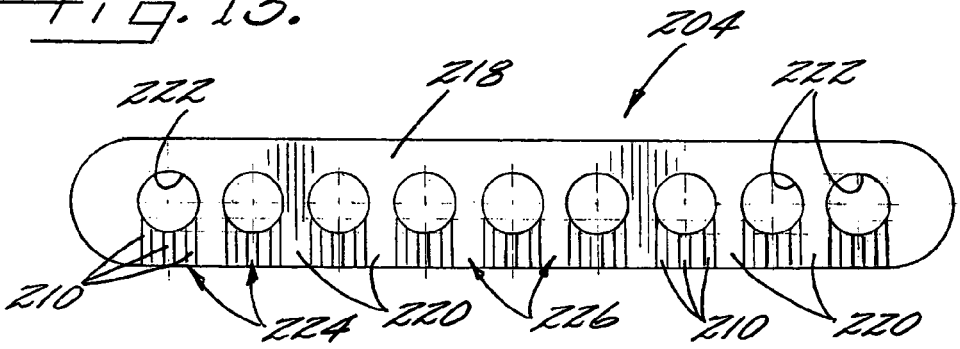

Having thus described the invention in general terms, reference will now be made to the accompanying drawings, which are not necessarily drawn to scale, and wherein:

FIG. 1 illustrates a portion of a prior art apparatus for making composite tubes that include four plies;

FIG. 2 illustrates a prior art container that is in the form a tube with capped ends;

FIG. 3 schematically illustrates a prior art process for applying an adhesive to a ply before the ply is spirally wound upon, and adhered to, a ply which was most recently previously wrapped around the mandrel illustrated in FIG. 1;

FIG. 4 is a schematic plan view of the prior art scraper illustrated in FIG. 3;

FIG. 5 is a schematic top plan view of a portion of the ply that is immediately downstream from the scraper in FIG. 3, with FIG. 5 schematically illustrating adhesive arranged in a series of longitudinally extending stripes, in accordance with the prior art;

FIG. 6 is an enlarged view of a portion of the prior art scraper illustrated in FIGS. 3 and 4;

FIG. 7 is a schematic plan view of a scraper to be used in place of the scraper of FIG. 3, in accordance with an embodiment of the present invention;

FIG. 8 is a schematic top plan view of a portion of a ply that is immediately downstream from the scraper of FIG. 7, with FIG. 8 schematically illustrating adhesive arranged in a series of initial stripes;

FIG. 9 is a schematic pictorial view in which plies of a previously formed tube have been partially pulled away from the remainder of the tube to illustrate adhesive stripes which result from spreading of the initial adhesive stripes illustrated in FIG. 8;

FIG. 10 schematically illustrates a ply being drawn across an applicator for applying and arranging adhesive on the lower surface of the ply in the manner illustrated in FIG. 8;

FIG. 11 is similar to FIG. 10, except it is a pictorial view and an insert of the applicator is shown exploded away from a housing of the applicator;

FIG. 12 is a cross-sectional view taken along line 12-12 of FIG. 11 while the insert is not exploded away from the housing;

FIG. 13 is a cross-sectional view of a portion of a face of the housing taken along line 13-13 of FIG. 12, and FIG. 13 illustrates recesses of the housing; and FIG. 14 is an isolated top plan view of an insert which can be interchanged with the insert shown in FIG. 11.

DETAILED DESCRIPTION OF THE INVENTION

The present invention will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

A composite tube of an embodiment of the present invention, as well as the methods and apparatus for manufacturing the composite tube, are as described above for FIGS. 1-6, except for variations noted and variations that will be apparent to those of ordinary skill in the art in view of this disclosure. Reference numerals for items of the embodiments of the present invention which have some similarity to items described above for FIGS. 1-6 are incremented by 100.

Some features of the present invention will initially be briefly and generally described with reference to FIGS. 7-9, followed by a more detailed description. FIG. 7 is a schematic view of a scraper 140 which is used in place of the scraper 40 of FIG. 3 for arranging adhesive, and FIG. 7 is illustrative of each plan and elevation view of the scraper 140. Generally described, recesses 142 of the scraper 140 are arranged in a predetermined manner so that, as illustrated in FIG. 8, initial adhesive stripes 144 are arranged in a predetermined manner on a portion of a ply 126 (e.g., ply 126*c* of FIG. 9) at a position immediately downstream from the scraper 140.

As a result, and as partially and schematically illustrated in FIG. 9, during the wrapping of the ply 126*c* (e.g., see FIG. 1), the initial adhesive stripes 144 (FIG. 8) that are closely adjacent to one another preferably spread and merge with one another in a predetermined manner. Therefore, in the resulting tube 122, a lesser number of wider resulting adhesive stripes 146 are spaced apart from one another and adhere the inner surface of the ply 126*c* to the outer surface of the ply 126*b*. As schematically illustrated by the resulting adhesive stripes 146 in FIG. 9, a predetermined percentage of the inner surface of the ply 126*c* is not adhered to the outer surface of the ply 126*b*, and vice versa.

The ply 126*c* can be characterized as being "partially adhered" since a substantial predetermined percentage of the inner surface of the ply 126*c* is not adhered to the outer surface of the ply 126*b*. In this regard, the predetermined adhesive patterns of the present invention advantageously allow for a reduction in the amount of adhesive used and thereby advantageously decrease the amount of moisture that is introduced into a tube 122 during manufacturing. Reducing the moisture has numerous advantages, such as reducing or eliminating the requirement that tubes be dried during manufacturing. In addition, it has unexpectedly been found that the predetermined patterns do not result in significant sacrifices in the strength of the tubes. As an example, maintaining the strength of the tubes can be particularly beneficial when the tubes are used as cores, since cores can be exposed to significant stresses while products are wound onto them and unwound from them, and while the products are carried by the them.

Referring to FIG. 8 more specifically, it is a schematic top plan view of a portion of the ply 126 at a position immediately downstream from the scraper 140, or the like. As illustrated in FIG. 8, the scraper 140 functions so that the ply 126 has longitudinally extending adhesive-laden areas 148 and initial unladen areas 150 arranged in an alternating, laterally extending series. Each of the adhesive-laden areas 148 can include one or more of the initial adhesive stripes 144. Preferably each of the adhesive-laden areas 148 includes a laterally extending series of initial adhesive stripes 144 which are uniformly and closely spaced apart from one another. As illustrated in FIG. 8, each of the adhesive-laden areas 148 includes three initial adhesive stripes 144; however, each adhesive-laden area 148 can include a greater or less number of initial adhesive stripes 144. In addition, on a given ply 126, it is possible for different adhesive-laden areas 148 to contain different numbers of initial adhesive stripes 144 as compared to other adhesive-laden areas 148 on the same ply 126. In the stripe-like areas that are within adhesive-laden areas 148 and between adjacent initial adhesive stripes 144, there is preferably relatively little or substantially no adhesive, prior to the ply 126 being formed into the tube 122.

Regarding the laterally extending series in which the adhesive-laden areas 148 and initial unladen areas 150 are alternately arranged, for this series' laterally extending length, only a predetermined percentage of the length consists of the adhesive-laden areas 148. The predetermined percentage will vary depending upon the anticipated demands to which the tubes 122 will be exposed and the type of adhesive that is used. This predetermined percentage is preferably substantially less than 100%. More specifically, the predetermined percentage can preferably be within a range of about 90% to at least about 50%, or the range can be about 70% to about 80%, or the predetermined percentage can be about 75%. Regarding the adhesive-laden areas 148, some or preferably all of them can each have a laterally extending width that is within a range of about 7.5 millimeters to about 12.5 millimeters, or the range can be about 9 millimeters to about 11 millimeters, and preferably some or all of the adhesive-laden areas each have a laterally extending width of about 10 millimeters. Regarding the initial unladen areas 150, some or preferably all of them can each have a laterally extending width that is within a range of about 2 millimeters to about 12 millimeters, or the range can be about 3 millimeters to about 9 millimeters, and preferably some or all of the initial unladen areas each have a laterally extending width of about 4 millimeters.

Each of the initial adhesive stripes 144 preferably extends substantially uniformly for, and parallel to, the entire length of the ply 126 that is downstream from the scraper 140 and upstream from the mandrel 24. It is preferred for the adhesive that is arranged in the initial adhesive stripes 144 to be a water-based adhesive; however, other adhesives, such as adhesives with solvents other than water, can be used. Each of the initial adhesive stripes 144 is preferably substantially solid, meaning that it is substantially entirely the adhesive and does not include substantial absences of the adhesive.

In contrast to the adhesive-laden areas 148, each of the initial unladen areas 150 preferably includes substantially no adhesive or only a relatively thin layer of adhesive as compared to the adhesive-laden areas 148. Due to the alternating arrangement of the adhesive-laden and initial unladen areas 148, 150, a predetermined partial amount of the surface of the ply 126 is adhered to the adjacent ply when the tube 122 is formed, whereby the tube can be characterized as being "partially adhered." More specifically, FIG. 9 is a partially schematic, pictorial view in which the outer body ply 126*c* and the outermost ply 126*d* of the previously formed tube 122 have been partially pulled away from the remainder of the tube to illustrate resulting adhesive stripes 146 which adhere the inner surface of the outer body ply 126*c* to the outer surface of the inner body ply 126*b*. The resulting adhesive stripes 146 preferably result from respective spreading of the initial adhesive stripes 144 of FIG. 8 when the ply 126*c* carrying the initial adhesive stripes 144 is wrapped onto the ply 126*b*. FIG. 9 is partially schematic, for example, because it is likely that the schematically illustrated resulting adhesive stripes 146 of FIG. 9 would be apparent on both the inner surface of the outer body ply 126*c* and the outer surface of the inner body ply 126*b*.

As shown in FIG. 9, resulting unladen areas 152 are respectively between the resulting adhesive stripes 146. Each of the resulting unladen areas 152 includes substantially no adhesive or only a relatively thin layer of adhesive as compared to the resulting adhesive stripes 146. The widths of the resulting adhesive stripes and unladen areas 146, 152 are respectively about the same as the widths of the adhesive-laden and initial unladen areas 148, 150 (FIG. 8); although the spreading of the initial adhesive stripes 144 when the tube 122 is formed probably will cause: the resulting adhesive stripes 146 to be slightly wider than the adhesive-laden areas 148, and the resulting unladen areas 152 to be slightly narrower than the initial unladen areas. For example, each of the resulting adhesive stripes 146 can have a width of about 10 millimeters, or this width can be in a range of about 9 millimeters to about 11 millimeters, or this width can be in a range of about 7.5 millimeters to about 12.5 millimeters. Regarding the resulting unladen areas 152, some or preferably all of them can each have a laterally extending width that is within a range of about 2 millimeters to about 12 millimeters, or the range can be about 3 millimeters to about 9 millimeters, and preferably some or all of the resulting unladen areas each have a laterally extending width of about 4 millimeters.

FIG. 9 is partially schematic because, for example, it is preferred for the side edges of the different plies 126*a-d* not to be aligned with one another. However, variations are within the scope of the present invention. For each of the plies 126*a-d* of the tube 122, the edges of the ply preferably abut one another to form a butt joint. As a result, and without regard to the resulting adhesive stripes 146, 100% of the outer surface of the innermost ply 126*a* confronts the inner surface of the inner body ply 126*b*, 100% of the outer surface of the inner body ply 126*b* confronts the inner surface of the outer body ply 126*c*, and 100% of the outer surface of the outer body ply 126*c* confronts the inner surface of the outermost ply 126*d*. Alternatively, the butt joints can be replaced with other types of joints, such as overlap joints.

In accordance with one example, the ply 126 illustrated in FIG. 8 is representative of each of the plies 126*b-d* prior to their being wrapped onto the respective ply most recently previously wrapped around the mandrel 24. In accordance with this example, the adhesive stripes 146 schematically illustrated in FIG. 9 are further representative of each of: the adhesive stripes between the inner surface of the outermost ply 126*d* and the outer surface of the outer body ply 126*c*, and the adhesive stripes between the inner surface of the inner body ply 126*b* and the outer surface of the innermost ply 126*a*. That is, the adhesive stripes 146 schematically illustrated in FIG. 9 are representative of the adhesive stripes between each of: the confronting surfaces of the outer body ply 126*c* and the inner body ply 126*b*, the confronting surfaces of the outermost ply 126*d* and the outer body ply 126*c*, and the confronting surfaces of the inner body ply 126*b* and the innermost ply 126*a*.

The adhesive-laden and initial unladen areas 148, 150 (FIG. 8) are preferably respectively sized and arranged on what will become the inner surface of one or more of the plies 126*b-d* so that for the respective confronting surfaces of the plies 126*a-d* of the tube 122, a predetermined percentage of the confronting surfaces are not adhered to one another. For example, FIG. 9 schematically illustrates that a predetermined percentage of (i.e., the resulting unladen areas 152 of) the confronting surfaces of the inner body ply 126*b* and the outer body ply 126*c* are not adhered together. Stated differently, FIG. 9 schematically illustrates that only a predetermined percentage of the confronting surfaces of the inner body ply 126*b* and the outer body ply 126*c* are adhered together. In accordance with one example, it is also the case that: only a predetermined percentage of the confronting surfaces of the innermost ply 126*a* and the inner body ply 126*b* are adhered together, and only a predetermined percentage of the confronting surfaces of the outer body ply 126*c* and the outermost ply 126*d* are adhered together. The predetermined percentage will vary depending upon the anticipated demands to which the tubes 122 will be exposed and the type of adhesive that is used. The predetermined percentage is preferably substantially less than 100% and large enough so that there is substantially secure attachment that enables the tube to be used as a core and withstand the associated stress. More specifically, the predetermined percentage can preferably be at least about 50% to about 90%, or about 70% to about 80%, or about 75%.

As partially mentioned above and as best understood with reference to FIG. 8, the initial adhesive stripes 144, adhesive-laden areas 148 and initial unladen areas 150 preferably each extend substantially uniformly and continuously along, and parallel to, the respective ply 126 from the scraper 140 to proximate the mandrel 24. Likewise, and as best understood with reference to FIG. 9, the resulting adhesive stripes and unladen areas 146, 152 preferably each extend uniformly and continuously along, and parallel to, the respective ply 126 from one end of the tube 122 to the other end of the tube. As a result, the resulting adhesive stripes and unladen areas 146, 152 each extend helically, and most preferably spirally, at least partially around the lengthwise axis of the tube 122, and if the tube 122 is long enough the resulting adhesive stripes and unladen areas 146, 152 each extend helically, and most preferably spirally, completely around the lengthwise axis of the tube 122.

The body plies 126*b*, 126*c* can be referred to as structural body plies because they are each preferably thicker and stronger than the innermost ply 126*a* and the outermost ply 126*d*, such that the body plies 126*b*, 126*d* are responsible for providing a majority of the strength of the tube 122. In contrast to the body plies 126*b*, 126*d*, which can be primarily selected for their strength, the innermost ply 126*a* and the outermost ply 126*d* can be selected for other reasons. For example, it is common for a tube that is used as a core to be temporarily mounted onto a spindle which carries the tube and causes the tube to rotate, and the innermost ply 126*a* can be selected so that it will be optimally compatible with the rotating spindle. Similarly, the outermost ply 126*c* can be selected so that it will be optimally compatible with the product that is wound onto the tube.

In accordance with one example, the innermost ply 126*a* is a ply of paper or polymeric material or other suitable material which has a thickness selected from the range of about 0.008 inch to about 0.015 inch, each of the inner and outer body plies 126*b*, 126*c* is a ply of paperboard or other suitable material which has a thickness selected from the range of about 0.020 inch to about 0.045 inch, and the outermost ply 126*d* is a ply of paper or polymeric material or other suitable material which has a thickness selected from the range of about 0.008 inch to about 0.015 inch.

It is within the scope of the present invention for one or more of the plies 126*a-d* to be omitted from the tube 122 (FIG. 9). For example, a winding core in particular can omit any non-structural plies such as plies 126*a* and 126*d*, such that all of the plies of the core comprise structural plies. Winding cores typically comprise at least 5 plies, and can have as many as 25 or more plies, depending on the strength requirements for the cores. The plies can vary in properties within the same winding core. For instance, a plurality of relatively high-strength (i.e., high-density, or HD) plies can be combined with a plurality of relatively low-strength (i.e., low-density, or LD) plies in a given core. Advantages have been found to be attained by arranging HD and LD plies in different ways, such as LD/HD/LD (i.e., where the HD plies are located between radially outward and radially inward LD plies), or HD/LD/HD (i.e., where the LD plies are located between outward and inward HD plies). Winding cores can have inside diameters ranging from about 3 inches to about 6 inches or more, and can have lengths from about 30 inches up to 170 inches or even more.

Referring back to the scraper 140 of FIG. 7 more specifically, the arrangement of the initial adhesive stripes 144 of FIG. 8 can be achieved (i.e., the partially adhered tube 122 can be manufactured) using the scraper 140, or the like. That is, the scraper 140 can function as, and can be characterized as, an arranging mechanism for arranging the initial adhesive stripes 144 and the adhesive-laden and initial unladen areas 148, 150 that are illustrated in FIG. 8.

The scraper 140 is preferably in the form of a cylindrical rod with a series of recesses 142 formed therein, and except for where the recesses 142 are located the diameter of the rod is preferably uniform along the length of the rod. The recesses 142 can be at least generally like the recesses 42 illustrated in FIG. 6, except that the recesses 142 are arranged so that recessed and unrecessed sections 154, 156 of the scraper 140 are arranged in an alternating series along the length of the scraper 140. Preferably, each recess 142 is annular (i.e., completely encircles the rod) and extends uniformly for its entire annular length. Alternatively, the recesses 142 may only partially encircle the rod or be formed, for example, at an edge of a scraper that is not in the form of a rod.

As apparent from a comparison between FIGS. 7 and 8, the alternating series of recessed and unrecessed sections 154, 156 of the scraper 140 corresponds to the alternating series of adhesive-laden and initial unladen areas 148, 150 along the ply 126. Protruding portions of the scraper 140 (i.e., outer portions of the scraper that are not the recesses 142 of the scraper) respectively remove the adhesive from the initial unladen areas 150 and from any predetermined portions of the adhesive-laden areas 148 (i.e., any portions of the adhesive-laden areas 148 that are not covered by the initial adhesive stripes 144) by scraping these areas. This scraping does not occur at the recesses 142.

Regarding the laterally extending series in which the recessed and unrecessed sections 154, 156 of the scraper 140 are arranged, for this series' length, only a predetermined percentage of the length consists of the recessed sections 154. The predetermined percentage will vary depending upon the anticipated demands to which the tubes 122 will be exposed and the type of adhesive that is used. The predetermined percentage is preferably substantially less than 100%. More specifically, the predetermined percentage can preferably be within a range of about 90% to at least about 50%, or the range can be about 70% to about 80%, or the predetermined percentage can be about 75%. Regarding the recessed sections 154, some or preferably all of them can each have a length (measured in the lengthwise direction of the scraper 140) within a range of about 7.5 millimeters to about 12.5 millimeters, or the range can be about 9 millimeters to about 11 millimeters, and preferably some or all of the recessed sections each have a length of about 10 millimeters.

The scraper 140 can have a diameter (measured at one of the unrecessed sections 156) of about 20 millimeters and its recesses 142 can each be 0.05, 0.10, 0.15, 0.2, 0.25 or 0.30 millimeters in depth. The amount of adhesive applied is generally proportional to the depth of the recesses 142. In each of the recessed sections 154, adjacent recesses 142 are preferably spaced apart by about 2 millimeters. It is preferred for adjacent recessed sections 154 to be spaced apart by substantially more than 2 millimeters, such as by about or at least about 3 or 4 millimeters in accordance with one example. Various arrangements of the recessed and unrecessed sections 154, 156 are within the scope of the present invention. For example, although each recessed section 154 is shown as including three recesses 142 in FIG. 7, each recessed section 154 can include a greater or lesser member of recesses 142, and the number of recesses 142 can vary between recessed sections 154 on the same scraper 140. Corresponding variations will occur in the adhesive patterns on the plies. It is preferred for all of the recessed sections 154 to be substantially identical.

Referring back to FIG. 8, there may be a relatively thin layer of adhesive (preferably a negligible amount) in the unladen areas 150 as compared to the adhesive-laden areas 148. In addition, in some situations, and depending upon the speed at which the ply 126 is drawn past the scraper 140, the adhesive may exert too much hydraulic pressure at the interface between the scraper 140 and the ply 126. This can result in a loss of optimal control (e.g., application of too much adhesive). In accordance with one aspect, these issues are addressed through the use of a an applicator 200, which is illustrated in FIGS. 10-12.

The applicator 200 can be used in place of the scraper 40 of FIG. 3, and the applicator 27 of FIG. 3 is omitted when the applicator 200 is used. The applicator 200 combines the functions of applying and arranging the adhesive on the ply 126 to form, for example, the pattern of the initial adhesive stripes 144 illustrated in FIG. 8. Although the applicator 200 could be used to apply the adhesive stripes 144 onto the top surface of the ply 126, it is preferred for the applicator to be used to apply the initial adhesive stripes 144 onto the bottom surface of the ply. Accordingly, and in contrast to what is illustrated in FIG. 1, when the applicator 200 is used in the manufacturing of the tube 122 (FIG. 9), the plies 126*b-d* are preferably introduced over the top of the mandrel 24.

As shown in FIGS. 10-12, a housing 202 of the applicator 200 includes a recessed face with upstream and downstream surfaces 206, 208 across which the ply 126 is drawn. The ply 126 is primarily shown in broken lines in FIGS. 10-13. The upstream surface 206 is arcuate and smooth. The downstream surface 208 is also arcuate. However, and in contrast to the upstream surface 206, the downstream surface 208 has a series of uniformly, closely spaced apart recesses 210 formed therein. Only a few of the recesses 210 are identified with their reference numeral in FIG. 11. Each of the recesses 210 in the downstream surface 208 can be generally like the recesses 142 of FIG. 7, except, for example, the recesses 210 are not annular and the distance between all adjacent recesses 210 is about the same, preferably 2 millimeters. Representative ones of the recesses 210 on the downstream surface 208 are shown in cross section in FIG. 13.

As best understood with reference to FIG. 11, a cavity 212 extends downwardly into the housing 202 at a position between the upstream and downstream surfaces 206, 208, and an adhesive-supplying passageway 214 extends from one end of the housing to the cavity. Another adhesive-supplying passageway, like the adhesive-supplying passageway 214 shown in FIGS. 10 and 11, can extend into the other end of the housing 202 and then to the cavity 212. During operation, the adhesive-supplying passageway(s) 214 are in fluid communication with, and downstream from, an adhesive supply. The adhesive supply can be a device for supplying the adhesive under a predetermined and controlled pressure. More specifically, the adhesive supply can be a pump that receives the adhesive from a reservoir and cause the adhesive to flow under pressure. An adjustable pressure regulator is preferably used in conjunction with the pump for controlling the pressure at which the adhesive is supplied, as will be discussed in greater detail below. Alternatively, the adhesive supply can be in other forms. For example, rather than using a pump, the reservoir containing the adhesive could be maintained at a sufficient elevation, or moved between elevations, to produce the desired pressure.

The applicator 200 further includes an insert 204 that is placed in the cavity 212 of the housing 202. An adhesive-supplying passageway 216 of the insert 204 extends through, or at least far into, the insert. The adhesive-supplying passageway 216 is open to the one or more adhesive supplying passageways 214 of the housing while the insert 204 is installed in the cavity 212 of the housing 202.

The insert 204 includes a face with upstream and downstream surfaces 218, 220 across which the ply 126 is drawn while the insert is in the cavity 212 of the housing 202. The upstream surface 218 of the insert 204 is preferably arcuate and smooth. As illustrated in FIG. 11, a series of spaced apart outlet openings 222 extend into the insert 204 at positions between the upstream and downstream surfaces 218, 220 of the insert. The outlet openings 222 are open to the adhesive-supplying passageway 216 that extends into the insert 204.

The downstream surface 220 of the insert 204 is arcuate and includes recessed and unrecessed sections 224, 226 that are arranged in an alternating series. The recessed sections 224 are respectively aligned with the outlet openings 222. Each recessed section 224 has one or more recesses 228 formed therein. As illustrated in FIG. 11, each recessed section 224 has a series of uniformly, closely spaced apart recesses 228 formed therein. Each of the recesses 228 of the recessed sections 224 can be generally like the recesses 210 of the housing 202. Only a few of the recessed and unrecessed sections 224, 226 and recesses 228 are identified by their reference numerals in FIG. 11. Various arrangements of the recessed and unrecessed sections 224, 226 are within the scope of the present invention. For example, although each recessed section 224 is shown as including three recesses 228 in FIG. 7, each recessed section 224 can include a greater or lesser member of recesses 228, and the number of recesses 228 can vary between recessed sections 224 on the same insert 204. As illustrated in FIG. 11, all of the outlet openings 222 are substantially identical, and all of the recessed sections 224 are substantially identical. The recesses 228 of the insert 204 are respectively aligned with recesses 210 of the housing 202 while the insert 204 is fully installed in the cavity 212 in the manner illustrated by FIGS. 10 and 12.

As apparent from a comparison between FIGS. 11 and 8, the alternating series of recessed and unrecessed sections 224, 226 of the insert 204 corresponds to the alternating series of adhesive-laden and initial unladen areas 148, 150 along the ply 126. For example, regarding the series in which the recessed and unrecessed sections 224, 226 of the insert 204 are arranged, for this series' length, only a predetermined percentage of the length consists of the recessed sections 224. The predetermined percentage will vary depending upon the anticipated demands to which the tubes 122 will be exposed and the type of adhesive that is used. The predetermined percentage is preferably substantially less than 100%. More specifically, the predetermined percentage can preferably be within a range of about 90% to at least about 50%, or the range can be about 70% to about 80%, or the predetermined percentage can be about 75%. Regarding the recessed sections 224, some or preferably all of them can each have a width, which extends in the direction of the series of recessed and unrecessed sections 224, 226, within a range of about 7.5 millimeters to about 12.5 millimeters, or the range can be about 9 millimeters to about 11 millimeters, and preferably some or all of the recessed sections each have a width of about 10 millimeters.

As illustrated in FIG. 11, the face of the insert 204 preferably includes unopen sections that are respectively adjacent the outlet openings 222, so that the outlet openings 222 and the adjacent unopen sections are arranged in a series that is for extending laterally across the ply and confronting the surface of the ply. As also apparent from a comparison between FIGS. 11 and 8, the alternating series of the outlet openings 222 and unopen sections of the insert 204 corresponds to the alternating series of initial adhesive-laden and unladen areas 148, 150 along the ply 126. For example, regarding the series in which the outlet openings 222 and unopen sections are arranged, for this series' length, only a predetermined percentage of the length consists of the outlet openings 222. The predetermined percentage will vary depending upon the anticipated demands to which the tubes 122 will be exposed and the type of adhesive that is used. The predetermined percentage is preferably substantially less than 100%. More specifically, the predetermined percentage can preferably be within a range of about 90% to at least about 50%, or the range can be about 70% to about 80%, or the predetermined percentage can be about 75%. Regarding the outlet openings 222, some or preferably all of them can each have a width, which extends in the direction of the series of outlet openings 222 and unopened sections, within a range of about 7.5 millimeters to about 12.5 millimeters, or the range can be about 9 millimeters to about 11 millimeters, and preferably some or all of the outlet openings each have a width of about 10 millimeters. Each of the outlet openings 222 can be circular, so that the respective above-mentioned widths can correspond to the diameters of the outlet openings.

As mentioned above, the applicator 200 is used in place of the scraper 40 of FIG. 1 and the applicator 14 of FIG. 1 is omitted. In use, the insert 204 is positioned in (and substantially fills) the cavity 212 of the housing 202 so that the outlet openings 222 of the insert are facing outwardly and between the upstream and downstream surfaces 206, 208 of the housing. In this configuration, the outlet openings 222 are the only outlets for adhesive that is supplied under pressure into the passageway(s) 214 of the housing 202. Then, the ply 126 is preferably drawn across the upstream and downstream surfaces 206, 208, 218, 220 of the housing 202 and insert 204 while the housing and insert are stationary, so that the ply forms a moving cover over the outlet openings 222 of the insert. The adhesive is supplied to the passageway(s) 214 of the housing 202 under pressure so that the adhesive flows out of the outlet openings 222 of the insert 204 and onto the bottom surface of the ply 126 that is passing in opposing face-to-face relation with the outlet openings 222.

The insert 204 illustrated in FIG. 11 is configured so that the adhesive is applied to the ply 126 in the manner illustrated by FIG. 8 (i.e., a partially adhered tube 122 can be manufactured). It is preferred for recesses 210 of the housing 202 which are respectively aligned with the recesses 228 of the insert 204 to operate in conjunction with the recesses 228 of the insert 204 to assist in the arranging of the initial adhesive stripes 144 and the adhesive-laden and initial unladen areas 148, 150. For the embodiment of the present invention illustrated in FIGS. 10-14, protruding portions of the downstream surfaces 208, 220 of the housing 202 and insert 204 (i.e., portions of the downstream surfaces 220, 208 other than the recesses 210, 228) substantially prevent adhesive from flowing into the initial unladen areas 150 (FIG. 8) and predetermined portions of the adhesive-laden areas 148 (FIG. 8) (i.e., any portions of the adhesive-laden areas 148 that are not covered by an initial adhesive stripe 144).

Advantageously, the pressure at which the adhesive is supplied to the passageway(s) 214 of the housing 202 and other variables can be optimally controlled so that substantially no adhesive is present in the unladen areas 150, 152 (FIGS. 8 and 9), and so that the adhesive does not exert too much hydraulic pressure at the interface between the applicator 200 and the ply 126 (e.g., too much adhesive is not applied/moisture content is decreased/the need for drying can be diminished or eliminated). In one example, the adhesive is applied at a pressure of about a 200 millimeter column of water.

The outlet openings 222 and the recessed sections 224 of the insert 204 can be respectively sized and arranged so that various predetermined percentages of the surface of the ply 126 to which adhesive is applied is adhered to the confronting surface of the adjacent ply when the tube 122 (FIG. 9) is formed. In this regard, a variety of differently configured inserts (e.g., see insert 204 of FIGS. 10-12 and insert 204' of FIG. 14) can be interchanged with one another/used in the same housing 202 to conveniently convert a manufacturing line so that it can utilize different amounts of adhesive/produce tubes with different characteristics (e.g., with various levels of adhesion). The insert 204' of FIG. 14 can be identical to the insert 204 of FIGS. 10-12, except that for variations that can be understood by comparing and contrasting FIGS. 11 and 14. Numerous reference numerals are omitted from FIG. 14 in an effort to clarify the view.

To provide a completely adhered tube, the insert 204 of FIG. 11 could be modified by replacing the outlet openings 222 with a single, elongate outlet opening, and the unrecessed sections 226 could be replaced with recessed sections 224. Even when forming a completely adhered tube with the applicator 200 (e.g., 100% of the surface of the ply to which adhesive is applied is adhered to the adjacent ply when the tube is formed), the applicator 200 advantageously operates (e.g., pressure can be controlled) so that the adhesive does not exert too much hydraulic pressure at the interface between the applicator and the ply (e.g., too much adhesive is not applied/moisture content is decreased/the need for drying can be diminished or eliminated).

In accordance with one embodiment of the present invention, a tube (e.g., see the tube 122 of FIG. 9) manufactured according to the present invention is about 50% adhered. That is, the predetermined percentage is about 50%. Features of the embodiment for which the predetermined percentage is about 50% (i.e., the 50% embodiment) can be respectively like corresponding features described above with reference to FIGS. 7-14, except for variations noted and variations that will be apparent to those of ordinary skill in the art in view of this disclosure. In accordance with the 50% embodiment, adhesive is arranged on a ply generally as illustrated in, and described above with reference to, FIG. 8. Therefore, the adhesive pattern of the 50% embodiment will be described using the reference numerals used in FIG. 8, and it can be best understood with reference to FIG. 8.

The adhesive is arranged on the ply 126 so that there is a laterally extending series consisting of seven unladen areas 150 and six laden areas 148. The two unladen areas 150 respectively adjacent the lengthwise edges of the ply 126 are each about 2 millimeters wide, the other unladen areas 150 are each about 12 millimeters wide, and each laden area 148 is about 10 millimeters wide. Each laden area 148 includes four initial adhesive stripes 144, and each of these adhesive stripes is about 1 millimeter wide. Within each laden area 148, the adjacent adhesive stripes 144 are spaced apart from one another by about 2 millimeters.

The adhesive on the ply 126 of the 50% embodiment can be arranged using a scraper that is generally like the scraper 140 of FIG. 7. Therefore, the scraper of the 50% embodiment will be described using the reference numerals used in FIG. 7 and can be best understood with reference to FIG. 7. The scraper 140 includes a laterally extending series consisting of seven unrecessed sections 156 and six recessed sections 154. The two unrecessed sections 156 respectively adjacent the ends of the scraper 140 are each about 2 millimeters wide, the other unrecessed sections 156 are each about 12 millimeters wide, and each recessed section 154 is about 10 millimeters wide. Each recessed section 154 includes four recesses 142, and each of those recesses has a maximum width of about 1 millimeter. Within each recessed section 154, the adjacent recesses 142 are spaced apart from one another by about 2 millimeters.

The adhesive on the ply 126 of the 50% embodiment can alternatively be applied and arranged using an applicator that is generally like the applicator 200 of FIG. 11. Therefore, the applicator of the 50% embodiment will be described using the reference numerals used in FIG. 11 and can be best understood with reference to FIG. 11. The insert 204 includes six outlet openings 222, and a laterally extending series consisting of seven unrecessed sections 226 and six recessed sections 224. The outlet openings 222 are respectively aligned with the recessed sections 224, and each of the outlet openings is about 10 millimeters wide. The two unrecessed sections 224 respectively adjacent the ends of the insert 204 are each about 2 millimeters wide, the other unrecessed sections 224 are each about 12 millimeters wide, and each recessed section 224 is about 10 millimeters wide. Each recessed section 224 includes four recesses 226, and each of those recesses has a maximum width of about 1 millimeter. Within each recessed section 224, the adjacent recesses 226 are spaced apart from one another by about 2 millimeters.

In accordance with another embodiment of the present invention, a tube (e.g., see the tube 122 of FIG. 9) manufactured according to the present invention is about 75% adhered. That is, the predetermined percentage is about 75%. Features of the embodiment for which the predetermined percentage is about 75% (i.e., the 75% embodiment) can be respectively like corresponding features described above with reference to FIGS. 7-14, except for variations noted and variations that will be apparent to those of ordinary skill in the art in view of this disclosure. In accordance with the 75% embodiment, adhesive is arranged on a ply generally as illustrated in, and described above with reference to, FIG. 8. Therefore, the adhesive pattern of the 75% embodiment will be described using the reference numerals used in FIG. 8, and it can be best understood with reference to FIG. 8.

The adhesive is arranged on the ply 126 so that there is a laterally extending series consisting of ten unladen areas 150 and nine laden areas 148. The two unladen areas 150 respectively adjacent the lengthwise edges of the ply 126 are each about 2 millimeters wide, the other unladen areas 150 are each about 4 millimeters wide, and each laden area 148 is about 10 millimeters wide. Each laden area 148 includes four initial adhesive stripes 144, and each of those initial adhesive stripes is about 1 millimeter wide. Within each laden area 148, the adjacent adhesive stripes 144 are spaced apart from one another by about 2 millimeters.

The adhesive on the ply 126 of the 75% embodiment can be arranged using a scraper that is generally like the scraper 140 of FIG. 7. Therefore, the scraper of the 75% embodiment will be described using the reference numerals used in FIG. 7 and can be best understood with reference to FIG. 7. The scraper 140 includes a laterally extending series consisting of ten unrecessed sections 156 and nine recessed sections 154. The two unrecessed sections 156 respectively adjacent the ends of the scraper 140 are each about 2 millimeters wide, the other unrecessed sections 156 are each about 4 millimeters wide, and each recessed section 154 is about 10 millimeters wide. Each recessed section 154 includes four recesses 142, and each of those recesses has a maximum width of about 1 millimeter. Within each recessed section 154, the adjacent recesses 142 are spaced apart from one another by about 2 millimeters.

The adhesive on the ply 126 of the 75% embodiment can alternatively be applied and arranged using an applicator that is generally like the applicator 200 of FIG. 11. Therefore, the applicator of the 75% embodiment will be described using the reference numerals used in FIG. 11 and can be best understood with reference to FIG. 11. The insert 204 includes nine outlet openings, and a laterally extending series consisting of ten unrecessed sections 226 and nine recessed sections 224. The outlet openings 222 are respectively aligned with the recessed sections, and each of the outlet openings is about 10 millimeters wide. The two unrecessed sections 224 respectively adjacent the ends of the insert 204 are each about 2 millimeters wide, the other unrecessed sections 224 are each about 4 millimeters wide, and each recessed section 224 is about 10 millimeters wide. Each recessed section 224 includes four recesses 226, and each of these recesses has a maximum width of about 1 millimeter. Within each recessed section 224, the adjacent recesses 228 are spaced apart from one another by about 2 millimeters.

In accordance with one embodiment of the present invention, a tube is formed by convolutely wrapping a single ply lengthwise around itself, rather than by spiral wrapping as described above with reference to FIG. 1. As an example, convolute wrapping can be performed generally in the manner in which a cigarette paper is rolled during the forming of a cigarette. Whereas tubes manufactured by way of spiral wrapping (e.g., see FIG. 1) and convolute wrapping can be cylindrical, tubes other than cylindrical tubes (e.g., tubes other than tubes having circular cross sections) are within the scope of the present invention. For example, it is common to utilize convolute wrapping in the manufacture a wide variety of differently shaped, noncylindrical tubes. As one specific example, tubes with polygon-shaped cross sections can be made by convolutely wrapping one or more plies about a polygon-shaped mandrel.

In accordance with each of first and second examples, a piece of 0.5 millimeter thick paperboard lengthwise around itself to form a cylindrical tube with twenty layers of the same ply, so that the tube has an overall wall thickness of about 10 millimeters, and an inner diameter of about 76 millimeters. A comparative example is identical to each of the first and second examples, except in the comparative example the adhesive is arranged so that the predetermined percentage is about 100% (i.e., about 100% of one side of the ply is adhered to the other side of the ply). In contrast, for the first example the adhesive is arranged so that the predetermined percentage is about 50% (i.e., about 50% of one side of the ply is adhered to the other side of the ply using a pattern as described above for the 50% embodiment). Similarly, for the second example the adhesive is arranged so that the predetermined percentage is about 75% (i.e., about 75% of one side of the ply is adhered to the other side of the ply using a pattern as described above for the 75% embodiment).

Each of the first, second and comparative examples are partially presented in the following table to provide a comparison that is illustrative of some of the advantageous aspects of the present invention.

| | Predetermined Percentage | | |
|---|---|---|---|
| | 100% | 75% | 50% |
| Flat Crush (N/100 millimeters) | 2546 | 2556 | 1974 |
| Radial Crush (bar) | 43.35 | 43.04 | 40.75 |
| Adhesive Coat Weight (g/m$^2$) | 53.3 | 41.7 | 26.25 |
| Moisture Added (% $H_2O$) | 4 | 3 | 2 |

Unexpectedly, test results illustrated by the foregoing table indicate that the flat crush strength of a partially adhered tube can be greater than the flat crush strength of a fully adhered tube that is otherwise identical. This can advantageously allow for a reduction in the amount of adhesive used and thereby advantageously decrease the amount of moisture that is introduced into a tube during manufacturing, without having to make significant sacrifices in strength. Reducing the moisture has numerous advantages, such as reducing or eliminating the requirement that tubes be dried during manufacturing. In addition, maintaining the strength of tubes can be particularly beneficial when the tubes are used as cores, since cores can be exposed to significant stresses while products are wound onto them and unwound from them, and while the products are carried by the them.

Prior to performing the testing that is illustrated by the above table, the tubes were dried to so that they each had about the same moisture content. That is, they were conditioned to be in equilibrium with an environment having a relative humidity of about 50%. Regarding the above table, the "flat crush" measurements were taken parallel to the lengthwise axes of the tubes, whereas the "radial crush" measurements were taken perpendicular to the lengthwise axes of the tubes. The adhesive coat weight is the weight of the adhesive adhering the surfaces of the ply to one another. The moisture added is the amount of moisture added to the tubes as a result of the adhesive adhering the surfaces of the ply to one another.

All of the dimensions specified above have been taken in the lateral direction (e.g., perpendicular to the preferred direction in which the ply 126 travels past the scraper 140 and applicator 200), unless indicated otherwise.

The tubes of the present invention are preferably used as cores, but the tubes of the present invention can also be used in the other manners in which it is known to use tubes.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A tube, comprising:

one or more plies wrapped around an axis of the tube; and adhesive which adheres an outer surface of a structural ply of the one or more plies to an inner surface, wherein:

the inner surface is:

part of the structural ply, or part of a second ply of the one or more plies, the outer surface confronts the inner surface, the adhesive is arranged in a predetermined pattern so that only a predetermined percentage of the outer surface is substantially adhered to the inner surface, the predetermined percentage is substantially less than 100% and large enough so that the outer surface is substantially securely attached to the inner surface, and the predetermined pattern includes at least four of the stripes of the adhesive and at least three of the second stripes.

2. A tube according to claim 1, wherein there are at least five of the stripes of the adhesive and at least four of the second stripes.

3. A method for forming a tube, comprising:

wrapping one or more plies around an axis so that an outer surface of a structural ply of the one or more plies confronts an inner surface, wherein the inner surface is:

part of the structural ply, or part of a second ply of the one or more plies; and adhering the outer surface and the inner surface to one another while the outer surface and the inner surface confront another and extend around the axis, with the adhering including arranging the adhesive in a predetermined pattern so that:

only a predetermined percentage of the outer surface is substantially adhered to the inner surface, with the predetermined percentage being substantially less than 100% and large enough so that the outer surface is substantially securely attached to the inner surface, the predetermined pattern includes a plurality of stripes of the adhesive, and the plurality of stripes of the adhesive includes at least three stripes of the adhesive, wherein the arranging of the plurality of stripes of the adhesive includes forming at least one of the stripes of the adhesive, and the forming of the one of the stripes of the adhesive includes forming a plurality of initial adhesive stripes and then spreading the plurality of initial adhesive stripes so that the initial adhesive stripes merge together and form the one of the stripes of the adhesive.

4. A method according to claim 3, wherein the wrapping of the one or more plies around the axis at least partially causes the spreading of the initial adhesive stripes.

5. A tube, comprising:

a plurality of plies helically wrapped around an axis of the tube and adhered together with adhesive, the plies including at least a structural ply, a second structural ply, a third ply, and a fourth ply, the adhesive adhering an outer surface of the structural ply to an inner surface of the second structural ply, adhering an outer surface of the third ply to an inner surface of the structural ply, and adhering an inner surface of the fourth ply to an outer surface of the second structural ply, wherein:

the adhesive between the structural ply and the second structural ply is arranged in a predetermined pattern so that only a predetermined percentage of the outer surface of the structural ply is substantially adhered to the inner surface of the second structural ply, the predetermined percentage is substantially less than 100% and large enough so that the outer surface of the structural ply is substantially securely attached to the inner surface of the second structural ply, and the predetermined pattern includes at least three stripes of the adhesive.

6. A tube according to claim 5, wherein the structural ply has a thickness within a range of about 0.020 inch to about 0.045 inch.

7. A tube according to claim 5, wherein the predetermined percentage is within a range of at least about 50% to about 90%.

8. A tube according to claim 7, wherein the range is about 70% to about 80%.

9. A tube according to claim 5, wherein the predetermined percentage is about 75%.

10. A tube according to claim 5, wherein at least a plurality of the stripes of the adhesive each have a width within a range of about 7.5 millimeters to about 12.5 millimeters.

11. A tube according to claim 5, wherein at least a plurality of the stripes of the adhesive each have a width within a range of about 9 millimeters to about 11 millimeters.

12. A tube according to claim 5, wherein at least some of the stripes of the adhesive each have a width of about 10 millimeters.

13. A tube according to claim 5, wherein each of the structural ply and second structural ply is a ply of paperboard which has a thickness within a range of about 0.020 inch to about 0.045 inch.

14. A tube according to claim 5, wherein:

the predetermined percentage is within a range of at least about 50% to about 90%, and at least a plurality of the stripes of the adhesive each have a width within a range of about 7.5 millimeters to about 12.5 millimeters.

15. A tube according to claim 5, wherein:

each of the stripes of the adhesive extends at least about parallel to the structural ply's length, the stripes of the adhesive and a plurality of second stripes are arranged in an alternating, laterally extending series such that each of the stripes of the adhesive is contiguous with at least one of the second stripes, and the second stripes are at least substantially absent of adhesive.

16. A tube according to claim 15, wherein:

a pair of the second stripes which are adjacent to one another are spaced apart from one another by a first distance, a pair of the stripes of the adhesive which are adjacent to one another are spaced apart from one another by a second distance, and the first distance and the second distance are substantially different from one another.

17. A tube according to claim 15, wherein each of the second stripes and each of the stripes of the adhesive extends helically at least partially around the axis of the tube.

18. A tube according to claim 15, wherein:

the tube includes opposite ends, each of the stripes of the adhesive extends substantially continuously from one of the ends of the tube to the other of the ends of the tube, and each of the stripes of the adhesive extends helically at least partially around the axis of the tube.

19. A tube according to claim 5, wherein the tube is cylindrical.

20. A method for forming a tube, comprising:

wrapping a plurality of plies helically around an axis one upon another, the plies including at least a structural ply, a second structural ply, a third ply, and a fourth ply;

adhering an outer surface of the structural ply to an inner surface of the second structural ply with an adhesive, adhering the third ply to an inner surface of the structural ply with an adhesive, and adhering the fourth ply to an outer surface of the second structural ply with an adhesive;

the adhering including arranging the adhesive between the structural ply and the second structural ply in a predetermined pattern so that:

only a predetermined percentage of the outer surface of the structural ply is substantially adhered to the inner surface of the second structural ply, with the predetermined percentage being substantially less than 100% and large enough so that the outer surface of the structural ply is substantially securely attached to the inner surface of the second structural ply, the predetermined pattern includes a plurality of stripes of the adhesive, and the plurality of stripes of the adhesive includes at least three stripes of the adhesive.

21. A method according to claim 20, wherein the predetermined percentage is within a range of at least about 50% to about 90%.

22. A method according to claim 21, wherein the range is about 70% to about 80%.

23. A method according to claim 20, wherein at least a plurality of the stripes of the adhesive each have a width within a range of about 7.5 millimeters to about 12.5 millimeters.

24. A method according to claim 20, wherein the adhering includes arranging the plurality of stripes of the adhesive so that the stripes of the adhesive and a plurality of second stripes are arranged in an alternating, laterally extending series such that each of the stripes of the adhesive is contiguous with at least one of the second stripes, and wherein each stripe of the adhesive extends at least about parallel to the length of the structural ply and is substantially solid, and the second stripes are substantially absent of adhesive.

25. A tube, comprising:

a plurality of plies wrapped around an axis of the tube and adhered together with adhesive, the plies including at least a first ply, a second ply, and a third ply, the adhesive adhering an outer surface of the first ply to an inner surface of the second ply, the adhesive adhering an outer surface of the third ply to an inner surface of the first ply, wherein:

the adhesive between the first ply and the second ply is arranged in a predetermined pattern so that only a predetermined percentage of the outer surface of the first ply is substantially adhered to the inner surface of the second ply, and the predetermined percentage is substantially less than 100% and large enough so that the outer surface of the first ply is substantially securely attached to the inner surface of the second ply; and the adhesive between the first ply and the third ply is arranged in a predetermined pattern so that only a predetermined percentage of the inner surface of the first ply is substantially adhered to the outer surface of the third ply, and the predetermined percentage is substantially less than 100% and large enough so that the inner surface of the first ply is substantially securely attached to the outer surface of the third ply.

26. The tube according to claim 25, wherein the first, second, and third plies are all paperboard plies.

27. The tube according to claim 25, wherein the tube includes at least five plies.

28. The tube according to claim 27, wherein the tube has an inside diameter of about 3 inches to about 6 inches, and a length of at least about 30 inches.

29. The tube according to claim 25, wherein the predetermined percentages are both within a range of at least about 50% to about 90%.

30. The tube according to claim 25, wherein the plurality of plies are helically wrapped around the axis.

* * * * *